United States Patent [19]

Goldman et al.

[11] 4,165,770

[45] Aug. 28, 1979

[54] APPARATUS TO REJUVENATE TENNIS BALLS

[76] Inventors: Julian Goldman; Martin Oppenheim, both of 250 174th St., Miami Beach, Fla. 33160

[21] Appl. No.: 784,573

[22] Filed: Apr. 4, 1977

[51] Int. Cl.[2] ..... B65B 31/08

[52] U.S. Cl. ..... 141/329; 46/90; 273/61 D

[58] Field of Search ..... 53/7, 79; 46/90; 141/19, 38, 46, 113, 114, 267, 276, 329, 330, 346, 351-355, 369; 156/145; 206/315; 273/61 D; 222/402.1, 402.13; 128/173 H, 184

[56] References Cited

U.S. PATENT DOCUMENTS

| | | | |
|---|---|---|---|
| 2,960,122 | 11/1960 | Fuller | 141/329 X |
| 3,917,127 | 11/1975 | Berenstain | 222/402.13 |
| 3,929,174 | 12/1975 | Isnardi | 53/7 X |
| 3,974,622 | 8/1976 | Stubblefield | 53/7 |
| 4,086,743 | 5/1978 | Hoopes | 141/329 |

*Primary Examiner*—Richard E. Aegerter
*Assistant Examiner*—Frederick R. Schmidt
*Attorney, Agent, or Firm*—Lackenbach, Lilling & Siegel

[57] ABSTRACT

An inflation device for tennis balls and the like wherein a pressure vessel having a resiliently closed discharge valve is provided with an operator fitting on the valve and a hollow impaling element on the operator fitting for passing fluid from the vessel, and an outwardly facing ball seat operatively connected to the fitting for actuating the latter upon depression by a ball on the seat, which ball is simultaneously penetrated by the impaling element for receiving pressurized fluid.

15 Claims, 5 Drawing Figures

APPARATUS TO REJUVENATE TENNIS BALLS

BACKGROUND OF THE INVENTION

Tennis is one of the most popular and fastest growing sports. One of the most common laments of its millions of devotees is that the balls do not last long enough. For professional tennis players the balls last for barely one set. For novices they may last as long as ten sets. But in any case, their life is so short that many a player has complained about the quality of tennis balls.

This invention does not purport to make a better ball, but rather provides means for prolonging the useful life of tennis balls. This invention provides efficient means for reinflating balls. This process can be repeated many times, and the active life of a tennis ball can be increased many times.

Devices to inflate balls and other objects are by no means new; they have been known for many years. Our invention, however, provides for a device to inflate balls in a quick, simple and fool-proof manner, thus minimizing the possibility of over-inflation or other damage.

Fineberg (U.S. Pat. No. 3,889,807) discloses a means for pressurizing tennis balls. A compression collar of a smaller diameter than the ball is used to compress the ball about its girth. Then two mold sections are fitted around the entire ball and all the pieces are squeezed tightly into one mold. This method does not involve injecting gas into the ball by means of a needle but, rather, the gas in the ball is subjected to great pressure.

Martino (U.S. Pat. No. 3,368,302), Copstead (U.S. Pat. No. 3,611,623). Elson (U.S. Pat. No. 3,768,501) and Collins (U.S. Pat. No. 3,796,181) diclose methods whereby balloons, or other inflatable objects, are attached to the valve or nozzle of a gas storage tank. By depressing a button, or other like means, an appropriate mechanism is activated and gas is forced into the balloon. These prior art devices, however, are not suitable for pressurizing a tennis ball, as a tennis ball, unlike a balloon, does not have an open end to which a valve or nozzle may be attached.

Brink (U.S. Pat. No. 3,921,977) discloses a device including a hypodermic needle to inject gas into a tennis ball. However, Brink's apparatus and process is long and complicated and does not lend itself to portability and court side use, whereas our device may be used at court side, with a minimum of complexity. Furthermore, Brink's needle is exposed and vulnerable to breaking, as opposed to ours which is safely protected in a sheath-like structure. Brink provides no means to protect the needle nor to accurately and safely align and puncture the ball with the needle. Brink relies solely on the dexterity of the hands of the user. A cursory examination of the drawings of the Brink patent will clearly show it is in no manner similar to our invention.

SUMMARY OF THE INVENTION

Therefore, it is an object of this invention to provide a device which will safely, easily, efficiently and quickly pressurize or rejuvenate tennis balls.

It is also an object of this invention to provide all these advantages in a single compact device.

These objects are achieved by our apparatus which comprises a system for introducing gas into a ball. Our system for introducing gas consists essentially of two cylindrical sleeves and a tubular body. A first or lower cylindrical sleeve is attachable to an aerosol can, and a second or upper sleeve is slidingly fitted over the first sleeve. One end of the second sleeve is provided with an end surface contoured to the shape of a ball. The tubular body is suspended in a chamber defined by the interior space of the two sleeves. A flange at one end of the tubular body interacts with the spray nozzle of an aerosol can and effects transmission of the gas from the aerosol can to the interior of the tubular body. A hollow needle is attached to another end of the tubular body, and this needle facilitates the passage of gas from inside the tubular body into the ball.

When the upper sleeve and ball are forced down, the needle passes through the top of the top sleeve penetrating the surface of the ball. The downward motion also causes the flange portion of the tubular body to interact with the spray nozzle of the aerosol can and to initiate the flow of gas. Upon removing the downward pressure on the top sleeve, a spring returns the device to its normal position.

Other objects will become apparent from the following detailed description of the invention when read in conjunction with the drawings.

DESCRIPTION OF THE PREFERRED EMBODIMENT

Figure 1:
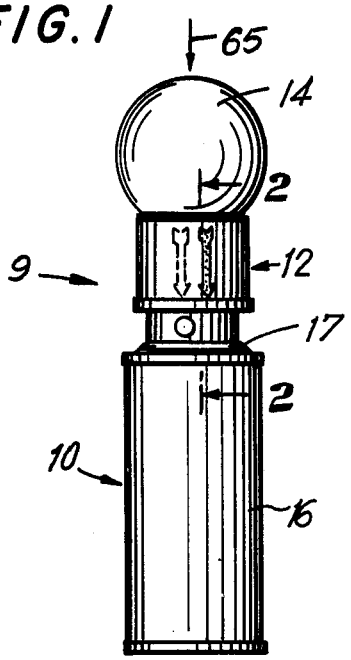
FIG. 1 is an elevational view showing a ball inflation device of the present invention, with a ball in position to be inflated.

Referring now more particularly to the drawings, and specifically to FIG. 1 thereof, there is shown a ball inflation device of the present invention generally designated 9, including a pressure vessel 10, which may be an aerosol can, an inflation mechanism or system 12 on the vessel 10, and a ball 14 in position to be inflated by the mechanism 12.

Figure 2:
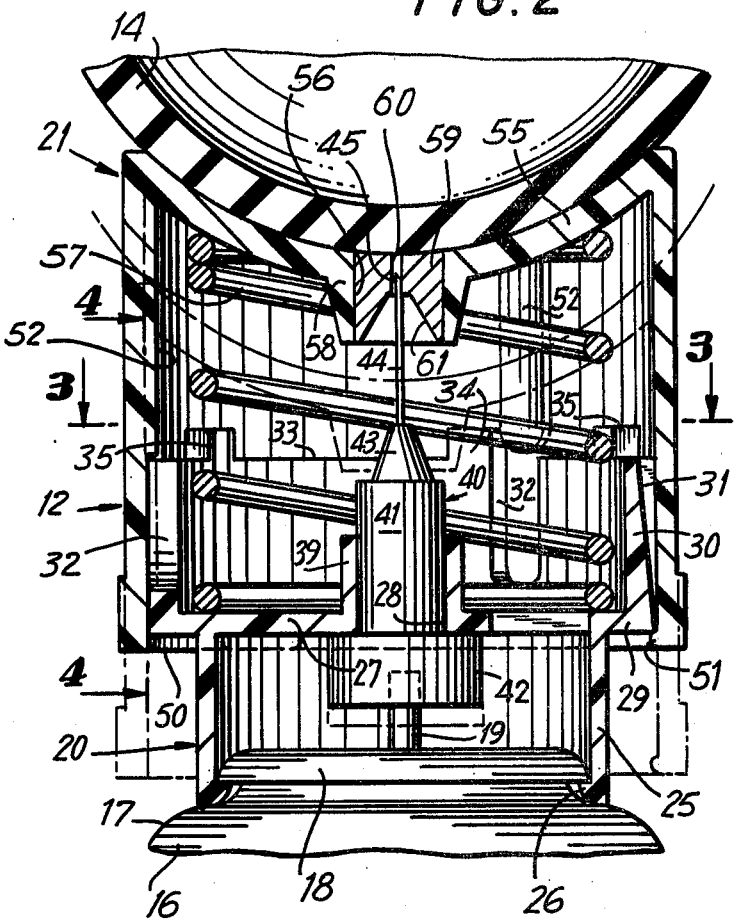
FIG. 2 is a partial sectional elevational view taken generally along the line 2—2 of FIG. 1.
Figure 4:
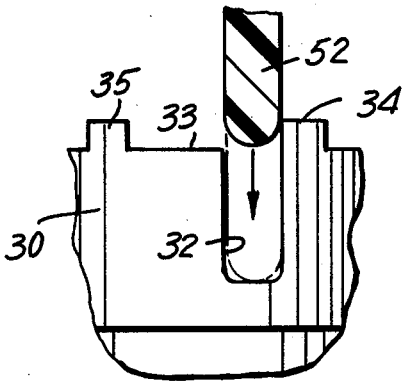
FIG. 4 is a fragmentary sectional view taken generally along the line 4—4 of FIG. 2 with the inflation device open or unlocked.
Figure 5:
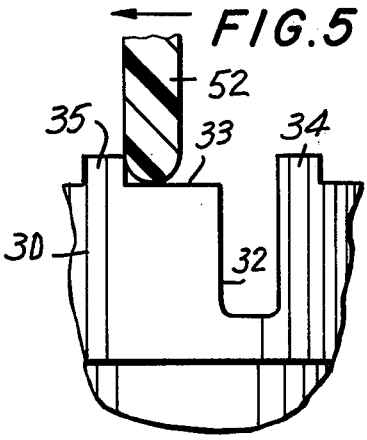
FIG. 5 is a partial sectional elevational view similar to FIG. 4 with the inflation device locked.

The pressure vessel 10 may be of any suitable type, preferably of an aerosol type and including a container or can 16 which may have its upper end reduced, as at 17, and provided with a generally annular, radially outstanding flange or lip 18, see FIG. 2. Centrally of the lip 18, there may be provided a conventional aerosol dispenser valve or spray nozzle 19. The discharge valve 19 is normally closed and suitably resiliently biased to its closed condition, and openable upon inward shifting against the outwardly biasing force. As thus far described, the inflation device may be generally conventional.

Figure 3:
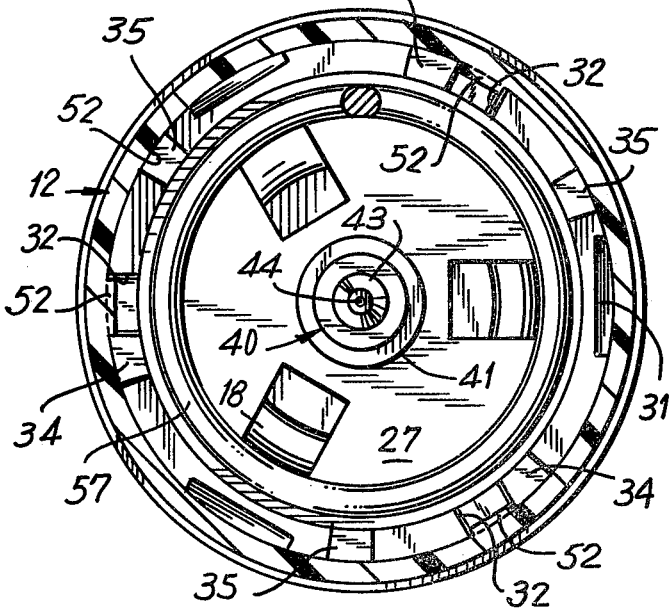
FIG. 3 is a horizontal sectional view taken generally along the line 3—3 of FIG. 2.

The ball inflation mechanism 12 is best seen in FIGS. 2 and 3, and may include a pair of generally telescopic sleeves 20 and 21. More particularly, the lower, inner sleeve 20 is attached to the aerosol can 16 to mount the mechanism 12 on the can. The upper or outer sleeve 21 is telescopically shiftable relative to the inner sleeve 20 for movement inward and outward toward and away from the can 16.

The inner sleeve 20 may include a smaller or reduced inner end portion 25 of generally cylindrical configuration and sized to engage about the annular lip 18. On the inner end edge of reduced sleeve portion 25 there may be provided inturned lips, flanges or barbs 26 for snap engagement over the flange 18 and retaining engagement therebeneath. Thus, the inner sleeve 20 is suitably affixed to can 16 by the snap interfitting engagement of flanges 26 with lip 18.

The inner end region 25 of inner sleeve 20 spacedly surrounds the discharge valve 19, and outward of the discharge valve is provided with a transverse wall or partition 27 having a central through opening 28 and extending radially outwardly beyond the reduced portion 25, as at 29. Upstanding from the outer edge of the outstanding partition wall portion 29 is an outer or enlarged portion 30 of inner sleeve 20. The sleeve portion 30 is generally cylindrical, being formed at circumferentially spaced locations with a plurality of beveled, oblique or inclined grooves 31, and at other circumferentially spaced locations with a plurality of slots or notches 32 each extending generally downwardly or inwardly from the upper edge 33 of sleeve 20 toward and terminating short of the outstanding of offsetting wall portion 29. The upper or outer edge 33 of the enlarged inner sleeve portion 30 may be provided with one or more pairs of upstanding lugs 34 and 35 adjacent to and on opposite sides of a respective notch of slot 32. Each lug 34 may have one side substantially flush with the adjacent slot 32, and each lug 35 may be on the other side of and spaced from the adjacent slot 32.

The central hole 28 of partition wall 27 may be coaxially aligned with the discharge valve 19, and bounding the opening or hole 28 may be a generally cylindrical upstanding guide wall or flange 39. Slidably disposed within the opening 28 and guided therein by wall 39 is a generally tubular body or operator fitting 40. The tubular body or operator fitting 40 may include a generally cylindrical, tubular portion 41 slidably received within the guide wall 39 bounding opening 28. The inner end of the cylindrical body portion 41 may be provided inwardly of the partition wall 27, with an enlargement or circular flange 42, which is centrally open on its under or inner side for connection in fluid communication with the outer end of spray nozzle or discharge valve 19. The other or outer end of operator fitting 40 may be provided with a generally outwardly tapering or conical extension 43 for carrying a relatively sharp, hollow or tubular impaling element or needle 44. The needle 44 projects outwardly from the outer end of conical extension 43, generally coaxially of the latter and tubular body portion 41, and is provided on its outer end with a sharpened extremity, as by an oblique or diagonally cut end surface 45. The hollow impaling element or needle 44 is in fluid communication through the extension 43, tubular body 41 and enlargement 42 with the discharge valve or nozzle 19; and, upon opening of the valve 19 with the interior of the vessel 10.

The outer or upper sleeve 21 is generally cylindrical and of a diameter for sliding engagement externally about the enlarged inner sleeve portion 30. More specifically, the outer sleeve 21 may have its inner end open, as at 50, and provided thereabout with a plurality of inturned lips or nubs 51 for snap engagment beyond the radial wall extension 29 to retain the outer sleeve on the inner sleeve, while permitting telescopic relative movement therebetween. Assembly may be readily effected by merely engaging the outer sleeve 21 over the enlarged outer portion 30 of the inner sleeve 20 with the several nubs 51 each entering slidingly into a respective oblique groove 31 for snap engagement therebeyond.

The internal surface of the generally cylindrical outer sleeve 21 may be provided with a plurality of angularly spaced generally longitudinal projections or ribs 52, each extending from the outer end of outer sleeve 21 longitudinally toward and terminating short of the inner end of the outer sleeve. The ribs 52 are each located between an adjacent pair of lugs 34 and 35, and rotatable with the outer sleeve 21 into limiting engagement with the respective adjacent pair of lugs. Further, each rib 52 is angularly shiftable into limiting engagement with its adjacent lug 34, and in such position sized for entry into the adjacent slot or notch 32 for relative contractile telescopic action of the outer sleeve 21. However, upon rotation of the outer sleeve 21 to shift the ribs 52 out of alignment with respective slots 32, the ribs are engageable with the end surface 33 of the inner sleeve 20 to provide an interference fit and lock the sleeves 21 and 20 in their extended telescopic relation against contractile movement.

The outer end of the outer sleeve 21 may be closed by a generally concave end wall 55 defining a ball seat. That is, the end wall 55 may be generally spherically concave in its outwardly facing relation and provided with a central through opening 56 in alignment with the operator fitting 40 and needle 44.

The sleeves 20 and 21 are resiliently urged in their extended telescopic relation, as by a coil compression spring 57 circumposed spacedly about the operator fitting 40 within the sleeves 20 and 21, and having its opposite ends in bearing engagement with walls 27 and 55.

Surrounding the central opening 56 of the outer wall or seat 55, and extending inwardly therefrom, is a tubular formation 58. Mounted in the tubular formation 58 is a generally externally cylindrical bushing 59 having a central through bore or hole 60. The needle 44 has its outlet end 45 received in the bore 60. Further, the bushing 59 is formed with a generally internally conical, inwardly facing surface 61, which may be generally conformable to the outwardly facing conical surface of extension 43. Upon contractile movement of outer sleeve 21, against the force of spring 57, the internal inwardly facing surface 61 engages with the external outwardly facing surface 43 to depress operator member 40 and open discharge valve 19. This condition is shown in phantom in FIG. 2.

As the outer sleeve 21 is shifted inwardly, say by a force in the direction of arrow 65 in FIG. 1, the sharp end 45 of needle 44 will slide through bore 60 and project therebeyond for penetration through and into the interior of ball 14. Thus, with the hollow interior of the ball 14 in fluid communication through needle 45, operator fitting 40 and valve 19 with the contents of can 16, the fluid therein is expelled into the ball. Upon proper inflation of the ball, the latter is merely removed for use in its inflated condition. By reason of the oblique end angle 45 of needle 44, the ball is impaled by an oblique cut which is effectively self-sealing upon removal of the needle.

While any suitable pressurized fluid or gas may be employed in the aerosol can 16, Freon has been found satisfactory.

While the inflation mechanism 12 is adapted for economical mass production to warrant disposal after a single use, it is appreciated that the mechanism may be detachable from an empty pressure vessel for replacement on a full pressure vessel if desired. Also if desired, means may be provided for holding the inflation mechanism 12 with its sleeves 20 and 21 in their contracted telescopic relation, for inflation of the ball for a predetermined period, without the need for constant downward external force on the ball.

In practice, several of the components, say the sleeves 20 and 21, and operator fitting 40, may all be fabricated of plastic, for the economies of injection molding. However, it is advantageous that the bushing 59 and needle 44 be of metal, the needle for ease of penetration into a ball, and the bushing 59 to effectively protect the needle and resist gouging, and the like.

In the preferred embodiment of our invention, the needle end 45 is positioned very close to the outer end of the bushing 59 so that during the first ¼" of travel of the upper sleeve 21, the needle will pierce the ball. Upon further travel, the operator fitting 40 will be depressed so as to actuate the value 19. Ideally, the outside diameter of the needle will proximate 0.018". The inside diameter will be approximately 0.008". The length of the needle should be such so that about ½" of its overall length will extend beyond the outer sleeve 21 when the sleeve is in its fully depressed condition. The pressure of the fluid in the can 10 should be in the range of 36–37 pounds per square inch, at which pressure it will require from 2–5 seconds to properly rejunevate the ball, depending upon its condition.

While the need for sealant in the pressurized fluid has not been found essential, it may be incorporated therein for more positive sealing action at the end of inflation.

While the device of the present invention has been primarily developed and employed for use in inflating of tennis balls, it is appreciated that the instant device may be employed for a variety of balls, as desired.

Although the present invention has been described in some detail by way of illustration and example for purposes of clarity of understanding, it is understood that certain changes and modifications may be made within the spirit of the invention.

What is claimed is:

1. A ball inflation device comprising a vessel for containing pressurized fluid, a normally closed discharge valve carried by said vessel, an operator fitting on said discharge valve and resiliently depressible to open the valve, a hollow impaling element on said fitting for passing fluid from said vessel, and an outwardly facing ball seat outwardly of said fitting and impaling element for engaging a ball, mounting means mounting said seat for in and out movement toward and away from said vessel, said seat having a through opening for passing said impaling element outwardly into impaling engagment with a ball when said seat is moved toward said vessel, actuating means carried by said seat for actuating said fitting to operate said valve and pass fluid into a ball on said seat, and stop means associated with said ball seat and said mounting means for selectively preventing said seat from being moved toward said vessel and thereby preventing inadvertent and undesired passage of said impaling element through said seat through opening, said ball seat including a first sleeve spacedly surrounding said impaling element, and said mounting means including a second sleeve telescopic and rotatable with respect to said first sleeve and secured to said vessel, for sleeve extension and retraction on seat movement outward and inward respectively; resilient means yieldably extending said telescopic sleeves, said stop means on said sleeves being provided for selectively retaining the latter against retraction and being located in a selected angulate relation between said sleeves; and a bushing carried by said seat protectively surrounding said impaling element and defining said through opening.

2. A ball inflation device according to claim 1, said vessel comprising an aerosol can.

3. A ball inflation device according to claim 2, wherein said bushing is carried by said seat, said through opening being formed in said bushing and having dimensions selected to closely correspond to the dimensions of said impaling element to protectively surround the same with little clearance when said impaling element passes through said opening to thereby limit bending of said impaling element when the same moves outwardly for engagement with a ball.

4. A ball inflation device according to claim 1, said fitting having an outwardly facing engaging surface, and said actuating means having an inwardly facing engaging surface for actuating engagement with said outwardly facing fitting engaging surface to operate said valve.

5. A ball inflation device according to claim 1, said impaling element having an oblique cutting edge for ball cutting engagement without removing ball material.

6. A ball inflation device according to claim 1, said first sleeve being outwardly of said second sleeve, and further comprising a guide carried by said second sleeve in guiding relation with said fitting.

7. A ball inflation device according to claim 1, said bushing and impaling element being fabricated of metal.

8. A ball inflation device comprising a vessel for containing pressurized fluid, a normally closed discharge valve carried by said vessel, an operator fitting on said discharge valve and resiliently depressible to open the valve, a hollow impaling element on said fitting for passing fluid from said vessel, and an outwardly facing ball seat outwardly of said fitting and impaling element for engaging a ball, mounting means mounting said seat for in and out movement toward and away from said vessel, said seat having a through opening for passing said impaling element outwardly into impaling engagement with a ball when said seat is moved toward said vessel, actuating means carried by said seat for actuating said fitting to operate said valve and pass fluid into a ball on said seat, and stop means associated with said ball seat and said mounting means for selectively preventing said seat from being moved toward said vessel and thereby preventing inadvertent and undesired passage of said impaling element through said seat through opening said ball seat including a first sleeve spacedly surrounding said impaling element, and said mounting means including a second sleeve telescopic and rotatable with respect to said first sleeve and secured to said vessel, for sleeve extension and retraction on seat movement outward and inward, respectively; resilient means yieldably extending said telescopic sleeves, said stop means on said sleeves being provided for selectively retaining the latter against inadvertent retraction and being located in a selected angulate relation between said sleeves, said stop means comprising mating configurations on said first and second sleeves which are adapted to mate with each other during retraction or inward movement of said seat or first sleeve only when said mating configurations are angularly aligned by selected relative angular positioning of said first and second sleeves, said mating configurations providing an interference fit when said first and second sleeves and said mating configurations are not angularly aligned to thereby prevent inadvertent inward movement or retraction of said first sleeve or seat relative to said second sleeve.

9. A ball inflation device according to claim 8, said vessel comprising an aerosol can.

10. A ball inflation device according to claim 8, said fitting having an outwardly facing engaging surface, and said actuating means having an inwardly facing engaging surface for actuating engagement with said outwardly facing fitting engaging surface to operate said valve.

11. A ball inflation device according to claim 8, said impaling element having an oblique cutting edge for ball cutting engagement without removing ball material.

12. A ball inflation device according to claim 8, said first sleeve being outwardly of said second sleeve, and a guide carried by said second sleeve in guiding relation with said fitting.

13. A ball inflation device according to claim 8, wherein said first and second sleeves have facing or abutting surfaces, one of said sleeves being provided with at least one longitudinal projection or rib on its facing surface which is generally parallel to the axis of said sleeves; and the other of said sleeves is provided with a longitudinal slot or notch in its facing surface which is shaped and dimensioned to receive said projection or rib during retraction of said seat only when said rib and slot are in angular alignment.

14. A ball inflation device according to claim 8, further comprising a bushing carried by said seat, said through opening being formed in said bushing and having dimensions selected to closely correspond to the dimensions of said impaling element to protectively surround the same with little clearance when said impaling element passes through said opening to thereby limit bending of said impaling element when the same moves outwardly for engagement with a ball.

15. A ball inflation device according to claim 14, said bushing and impaling element being fabricated of metal.

* * * * *